US005591931A

United States Patent [19]

Dame

[11] Patent Number: 5,591,931

[45] Date of Patent: Jan. 7, 1997

[54] MUSICAL SIGNAL MULTIPLEXING CIRCUIT AND DEMULTIPLEXING SYSTEM

[75] Inventor: Stephen G. Dame, Everett, Wash.

[73] Assignee: Virtual DSP Corporation, Everett, Wash.

[21] Appl. No.: 373,442

[22] Filed: Jan. 17, 1995

[51] Int. Cl.[6] ..... G10H 1/053; G10H 1/12; G10H 3/18

[52] U.S. Cl. ..... 84/726; 84/736; 381/2

[58] Field of Search ..... 84/603, 617, 622–625, 84/646, 655, 660, 661, 682, 699, 700, 722–728, 736, 742, DIG. 30; 381/2, 29, 30; 358/310; 370/118; 332/103

[56] References Cited

U.S. PATENT DOCUMENTS

| | | | |
|---|---|---|---|
| 4,068,259 | 1/1978 | Tinet et al. | 358/310 X |
| 4,524,665 | 6/1985 | Bione et al. | 84/617 |
| 4,554,855 | 11/1985 | Alonso et al. | 84/625 |
| 4,622,680 | 11/1986 | Zinser | 381/29 X |
| 4,703,480 | 10/1987 | Westall | 381/30 X |
| 4,803,727 | 2/1989 | Holt et al. | 381/2 X |
| 4,999,831 | 3/1991 | Grace | 370/118 X |
| 5,024,134 | 6/1991 | Uchiyama | 84/722 X |
| 5,111,727 | 5/1992 | Rossum | 84/603 |
| 5,308,916 | 5/1994 | Murata et al. | 84/603 |
| 5,473,290 | 12/1995 | Scomazzon et al. | 332/103 |

*Primary Examiner*—Stanley J. Witkowski
*Attorney, Agent, or Firm*—Graybeal Jackson Haley & Johnson

[57] ABSTRACT

A circuit for multiplexing three or more audio band electrical signals into two audio band electrical signals which can be provided to a stereo input and a circuit and computer method for demultiplexing the signals. In particular, six signals from the six strings of a guitar are multiplexed for stereo audio analog input to a sound card in a personal computer where the signals are digitized and then, using software running on the computer, demultiplexed into six signals from which the frequencies above 4.5 kHz have been lost.

5 Claims, 3 Drawing Sheets

MUSICAL SIGNAL MULTIPLEXING CIRCUIT AND DEMULTIPLEXING SYSTEM

This invention relates to methods for transmitting musical pitch information from polyphonic musical sources to electronic musical devices which accept stereo audio input.

BACKGROUND OF THE INVENTION

In personal computers, sound cards for receiving musical input generally have two channels for receiving stereo audio signals. Each of the signals is digitized for processing or storage in the computer. Most or all sound cards can operate at numerous sample rates, and the highest sample rate at which most or all can operate is 44.1 kHz. Many personal computers with sound cards also include MIDI input ports.

With this hardware, computers can be programmed to receive one or two musical signal inputs through these stereo inputs and process these signals to calculate MIDI data which includes timing, frequency, and intensity for each note. However, if one wishes to obtain MIDI data, or equivalent data, from more than two sources at one time, such as from the six strings of a guitar, additional hardware is required. The available hardware includes a separate electrical connection from each of six pickups, one from each string of the guitar, into a specialized processor with six input channels which generates MIDI or equivalent data that can be transmitted to a computer or other electrical musical device through a MIDI port or a serial port. This equipment is expensive and quite limited in its ability to accurately determine the pitch of each note in a short interval of time once the note is struck and to accurately determine correct timing data for each note. What is needed is a simple hardware device which can get the audio signal information into a personal computer so that, by running powerful software, the personal computer can accurately compute correct timing for each note and correct pitch for each note. From these computations, accurate MIDI, or equivalent, data can be computed.

SUMMARY OF THE INVENTION

The invention is a hardware device for receiving six audio signal inputs and multiplexing them into two stereo signals within the portion of the audio band which can be accurately sampled at a digital sampling rate of 44.1 kHz. The invention includes a method for demultiplexing the two stereo audio signals to produce an audio signal similar to the original for each of the six individual guitar strings. The audio signals contain all of the needed pitch, timing and intensity information.

Because the information for six strings must be combined into two signal channels with a limited usable bandwidth due to limitations of the sampling rates of sound cards, the six demultiplexed signals do not include the higher frequency components of the original signals. However, the primary pitch, which is all that is required for MIDI or equivalent data, is the lowest pitch in each of the signals. The signals reproduced in the computer include higher pitched frequencies up to about 4,500 Hz and this is sufficient to retain enough of the original character of the input signals to be of interest to musicians for reproducing the original music from the computer memory.

The invented hardware and demultiplexing methods can be adapted to any problem of combining more than two musical signals into a smaller number of musical signals for transmission to an electronic musical device and then reproducing the original signals but with some loss of bandwidth for each signal.

If the computer is fast enough, the six signals can be converted to MIDI or equivalent data in real time as the signals are coming in or, if not, the original data for the six signals can be stored in a memory and converted to MIDI or equivalent data with subsequent batch processing.

DETAILED DESCRIPTION OF THE PREFERRED EMBODIMENT

Figure 1:
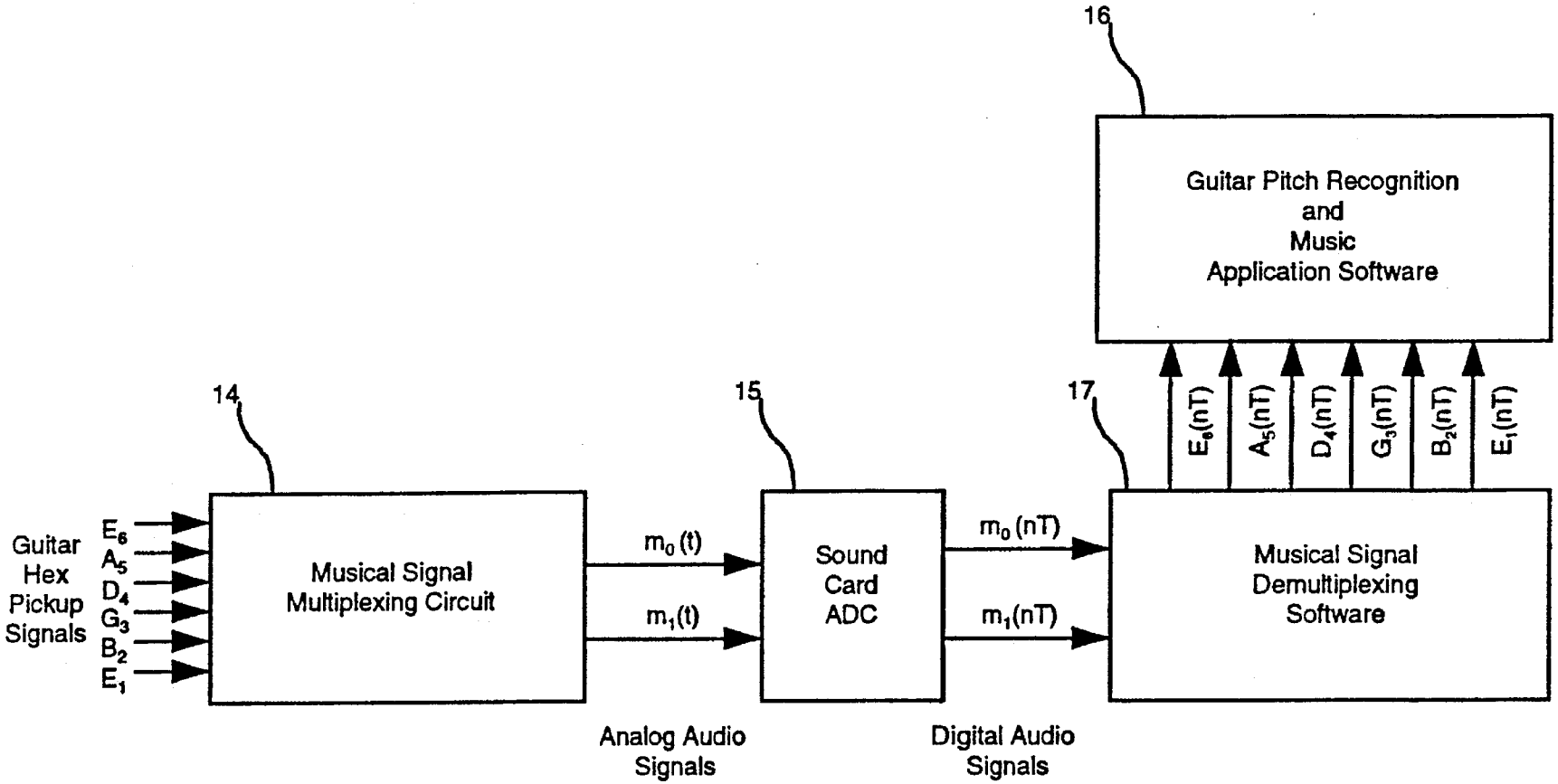
FIG. 1 shows a block diagram of the complete system.

FIG. 1 shows a block diagram of a preferred embodiment of the invention in which a hex pickup-equipped guitar is connected to the musical signal multiplexing circuit 14. The audio output of the musical signal multiplexing circuit 14 is then connected to a CD-quality audio input of a typical personal computer sound card 15. The digital audio signal obtained from the sound card 15 is then demultiplexed with the computer controlled by software 17 and the resulting demultiplexed digital audio signals are then fed into a software application 16 which analyzes the resulting signals for pitch and signal strength.

Figure 2:
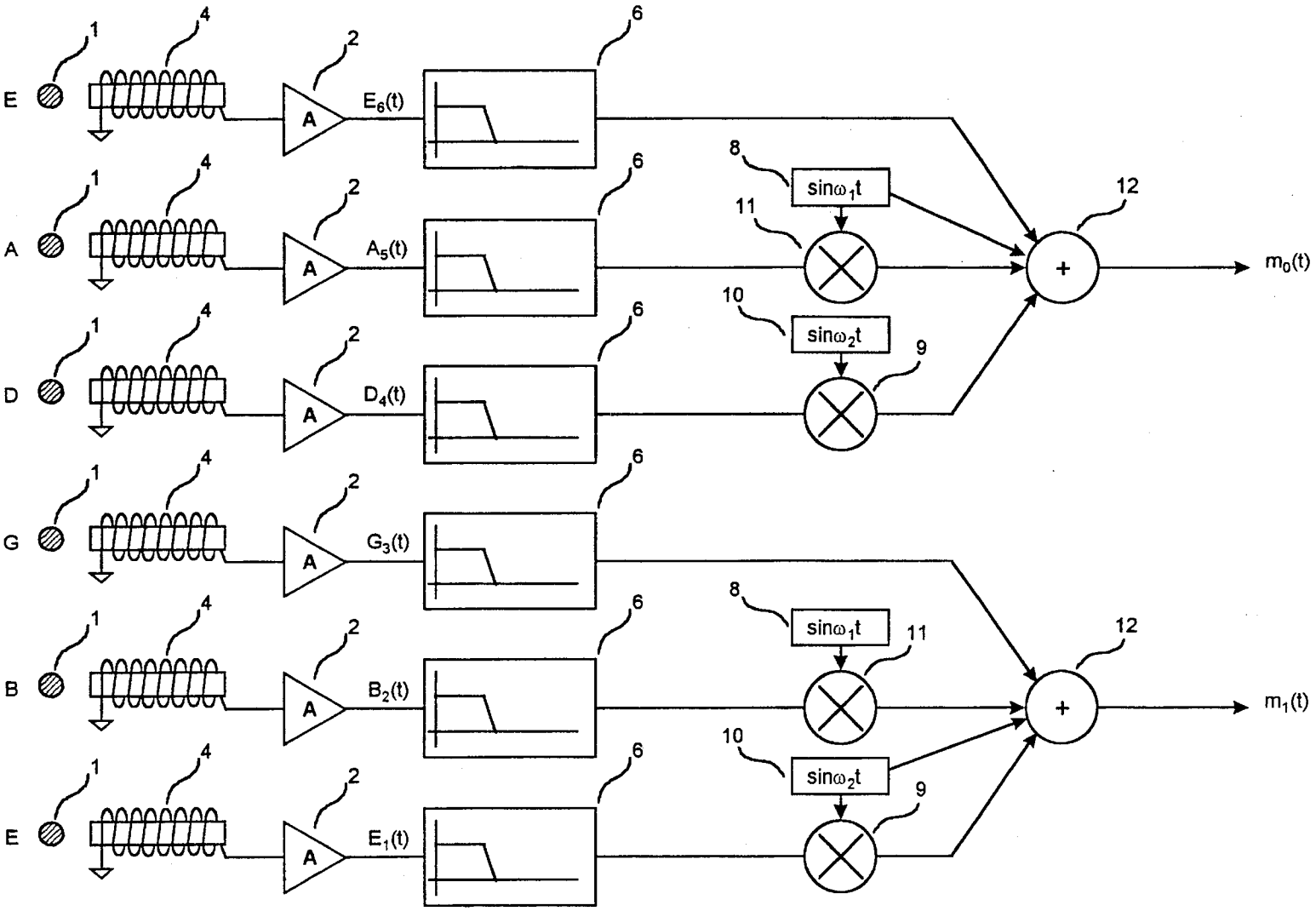
FIG. 2 is a block diagram showing the circuitry from the signal pickups through the multiplexer to stereo output.

The musical signal multiplexing circuit 14 as shown in FIG. 1 is detailed in FIG. 2. When the steel guitar string 1 vibrates, a standard electric guitar pickup coil 4 for each string generates a signal. The six signals are each fed into six adjustable amplifiers 2. The amplifiers are adjusted to compensate for differences in coil efficiency, coil positioning relative to the string, and string diameter to produce equal signal strength for each audio signal receiver of the multiplexer. The output of each amplifier is then coupled to a frequency band limiting filter 6 as the audio signal receiver. In the preferred embodiment, the filters are lowpass filters with a frequency cutoff curve beginning at 4 kHz and effectively achieving total cutoff at 5 kHz.

The signals are then grouped in two groups of three. The grouping is arbitrary. In each group of three, a first of the filters is coupled to a first carrier multiplying circuit 11, which multiplies the input signal by a first sinusoidal carrier frequency which is produced by a first carrier generating circuit 8. The output from the first carrier multiplying circuit 11 is coupled to an adding circuit 12.

In each group of three, the output of a second filter 6 is coupled to a second carrier multiplying circuit 9, which is identical to the first carrier multiplying circuit 11. The second carrier multiplying circuit is coupled to a second carrier generating circuit 10 which provides a second sinusoidal carrier frequency to the second carrier multiplying circuit 9. Like the first carrier multiplying circuit, the output of the second carrier multiplying circuit 9 is also an input to the adding circuit 12.

The output from the third filter 6 in each group of three filters is provided directly to the adding circuit 12.

In the preferred embodiment, the first and the second carrier frequencies are selected so that one can be electronically or computationally derived from the other, but this is not required. Then, to aid in demultiplexing, the first carrier generating circuit 8 provides the first carrier frequency to one of the adding circuits, and the second carrier generating circuit 10 provides the second carrier frequency to the other of the adding circuits, as a fourth input to the adding circuit.

The highest sampling rate available in most sound cards is 44.1 Khz. Consequently, the effective bandwidth for analog to digital conversion is up to 22 kHz. In the preferred embodiment, the carrier frequencies are 9 kHz and 18 kHz. When multiplied by a source signal that diminishes quickly after 4 kHz and goes to 0 before 5 kHz, the higher frequency carrier will spread to an effective bandwidth of 14–22 kHz and the lower frequency carrier will spread to an effective bandwidth of 5–13 kHz, leaving 0–4 kHz for the signal which is not multiplied by a carrier frequency. The two carrier frequencies need not have any particular relationship to each other. In the preferred embodiment, the higher carrier frequency is twice the lower carrier frequency, allowing the carrier generating circuits to be easily built as a single unit which generates both frequencies and supplies both frequencies to both groups of three signals. For choosing the frequencies of each carrier and the lowpass filters, the only requirement is that, when each carrier is multiplied by frequencies which pass the filters, the resulting three signals can be combined without their frequency spectra significantly overlapping and without significantly exceeding the frequency input limitations of the target input device.

Figure 3:
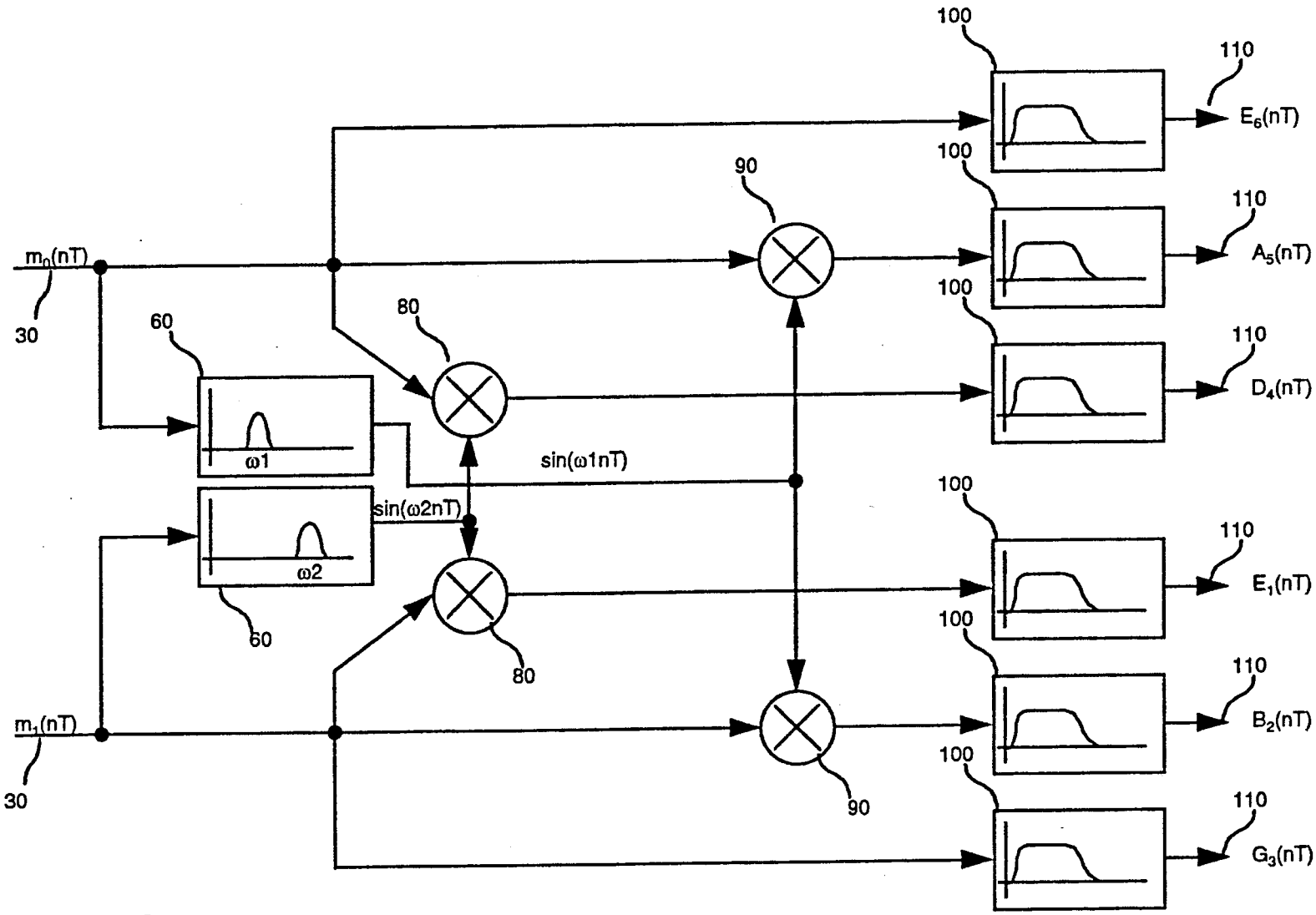
FIG. 3 is a block diagram showing the demultiplexer which may be implemented with circuitry as shown or with software in a computer.

As shown in FIG. 1, blocks 17 and 16 are indicated as implemented with software in a computer. Alternatively, block 17 can be implemented with a simple analog circuit, which eliminates the requirement of the analog to digital converter 15. Such a circuit is shown in FIG. 3.

Each of the stereo input signals 30 is coupled to a high Q bandpass filter 60, two multiplying circuits 80 and 90, and a bandpass output filter 100 which is coupled to one of the outputs 110. One of the high Q bandpass filters 60 is selected to pass one of the carrier frequencies and the other high Q bandpass filter 60 is selected to pass the other carrier frequency. The multiplier circuits 80 and 90 will cause their respective original input frequencies to appear in their original band. The outputs from each multiplier are coupled to baseband filters to remove all but the desired signals.

The upper edge of the baseband filter 100 is chosen to closely match the cutoff frequency of the multiplexing circuit's lowpass filters. The lower edge of the baseband filter is chosen to remove any DC component which is present in the demodulated signals due to the random phase possibility of the recovered carrier.

According to this embodiment, the system will not work correctly if the two stereo input signals are switched. Alternatively, not shown in FIGS. 2 or 3, both carrier signals may be added to both stereo outputs in FIG. 2 so that each carrier signal can be extracted from either of the stereo input signals in FIG. 3.

Although it is straightforward to build the analog demultiplexing circuit described above, for reasons of manufacturing economy, product cost, and product simplicity, the preferred embodiment implements the same circuit shown in FIG. 3 with software on a general purpose personal computer. As shown in FIG. 1, the analog signals $M_0(t)$ and $M_1(t)$ are input to the standard personal computer sound card which converts the multiplexed analog signals into digital signals identified as $m_0(nT)$ and $m_1(nT)$ which may then be demultiplexed by the software system 17 or may be stored in a memory prior to demultiplexing. T is 1/Fs; where Fs is the sampling frequency.

Below is a software pseudo code representation of FIG. 3. The routines represented by carrier_recovery_filter and baseband_filter are implemented as standard FIR or IIR filter types with the appropriate coefficients calculated by a suitable digital filter design software tool. Such tools are commonly known to digital signal processing engineers. The upper band edge for the routines represented by baseband_filter is chosen to closely match the cutoff frequency of the multiplexing circuit's lowpass filters. The lower edge of the filtering step represented by routine baseband_filter is chosen to remove any DC component present in the demodulated signals due to the random phase possibility of the recovered carrier.

```
Initialize Demodulation System
Loop_Forever
    m0(nT)        =   Get_ADC_Sample_left
    m1(nT)        =   Get_ADC_Sample_right
    sin(w1nT)     =   carrier_recovery_filter1[m0(nT)]
    sin(w2nT)     =   carrier_recovery_filter2[m1(nT)]
    A5_mod(nT)    =   m0(nT) * sin(w1nT)
    D4_mod(nT)    =   m0(nT) * sin(w2nT)
    E1_mod(nT)    =   m1(nT) * sin(w2nT)
    B2_mod(nT)    =   m1(nT) * sin(w1nT)
    E6(nT)    =   baseband_filter[m0(nT)]
    A5(nT)    =   baseband_filter[A5_mod(nT)]
    D4(nT)    =   baseband_filter[D4_mod(nT)]
    G3(nT)    =   baseband_filter[m1(nT)]
    B2(nT)    =   baseband_filter[B2_mod(nT)]
    E1(nT)    =   baseband_filter[E1_mod(nT)]
End_Loop
```

The program initializes its required system variables and registers. Then an infinite loop is entered where both channels of the digital source data are read into the m0(nT) and m1(nT) variables. If the loop runs as fast as the analog to digital sampling rate, the input data can be obtained from the analog to digital converter of the sound card as the original analog signal is coming in. Otherwise, the digital data is stored to a memory and retrieved from the memory for processing. If, when processing data from memory, the loop can run as fast as the sample rate, then the output will represent correctly paced music and it can be directly played as audible music. Otherwise, the output can be stored in a memory for subsequent playing as music. Typically, the output is used not as music but as a source for calculating MIDI or equivalent data.

Within the loop, once the first set of data has been obtained, the next step is to obtain the higher carrier frequency sin(w2nT) by calling a subroutine, carrier_recovery_filter that will perform high Q bandpass filtering to obtain the carrier signal. In the preferred embodiment, an IIR-type digital bandpass filter is used since a high filter Q is required and phase of the output signal is not important. The lower frequency carrier signal, sin(w1nT), is then obtained by the same process.

In the next four lines of code, four of the six signals are multiplied by the appropriate carriers. Finally, in the last six lines of the loop, the output of each of these four multiplications and the two un-multiplied signals are fed into the baseband filters to produce the desired digitally demultiplexed signals.

Although the above description specifies six channels for a standard guitar, the design can be scaled up or down for other instruments or musical sources with a larger or smaller number of original channels.

I claim:

1. An audio signal multiplexing device with audio band output comprising:

(a) three audio signal receivers, (b) three frequency band limiting filters, first through third, one coupled to each receiver, (c) a first carrier generating circuit which generates a first carrier frequency which, when multiplied by the frequencies which pass the filters, contains different enough frequencies from the frequencies which pass the filters to be filter-separable from such frequencies, (d) a second carrier generating circuit which generates a second carrier frequency which, when multiplied by the frequencies which pass the filters, contains different enough frequencies from the frequencies which pass the filters and from the frequencies of the first carrier frequency when multiplied by the frequencies which pass the filters to be filter-separable from both such sets of frequencies, (e) a first carrier multiplying circuit coupled to the first carrier generating circuit and to the first filter, (f) a second carrier multiplying circuit coupled to the second carrier generating circuit and to the second filter, and (g) an adding circuit, which produces an audio band signal, coupled to the first carrier multiplying circuit, to the second carrier multiplying circuit, to the third filter, to one of the two carrier generating circuits, and to an output.

2. The device of claim 1, further comprising three amplifiers, each coupled between one of the three receivers and its associated filter.

3. The device of claim 2, wherein each of the three receivers is a coil which generates a signal in response to movement of a nearby ferromagnetic material.

4. The device of claim 1, adapted to be an electric guitar pickup and signal processor, wherein:

(a) the audio signal receivers are guitar string pickups, and (b) the numbers of audio signal receivers, filters, carrier multiplying circuits, adding circuits, and outputs are doubled to accommodate six sources rather than three and produce two outputs rather than one.

5. The device of claim 4 wherein the filters and carrier frequencies are selected to generate output frequencies which do not exceed 25 kHz.

* * * * *